US006435256B1

(12) United States Patent
Anderson et al.

(10) Patent No.: US 6,435,256 B1
(45) Date of Patent: Aug. 20, 2002

(54) METHOD FOR PRODUCING A COOLED, LOST-WAX CAST PART

(75) Inventors: Gordon Anderson; Peter Marx, both of Baden; Shailendra Naik, Gebenstorf, all of (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/921,587

(22) Filed: Aug. 6, 2001

(30) Foreign Application Priority Data

Aug. 7, 2000 (DE) ..... 100 38 453

(51) Int. Cl.[7] ..... B22C 9/24

(52) U.S. Cl. ..... 164/35; 164/516; 164/32; 164/45

(58) Field of Search ..... 164/35, 516, 32, 164/45, 235, 369, 370

(56) References Cited

U.S. PATENT DOCUMENTS

| | | | | |
|---|---|---|---|---|
| 3,690,367 A | | 9/1972 | Daniels | 164/335 |
| 3,763,926 A | | 10/1973 | Tschinkel et al. | 164/338.1 |
| 5,296,308 A | | 3/1994 | Caccavale et al. | 164/516 |
| 5,489,194 A | | 2/1996 | Yoshinari et al. | 164/122.1 |
| 5,503,218 A | * | 4/1996 | Campion et al. | 164/516 |

FOREIGN PATENT DOCUMENTS

| | | |
|---|---|---|
| DE | 1783 103 | 9/1971 |
| DE | 38 13 287 | 9/1996 |
| DE | 197 26 111 | 11/1998 |
| DE | 695 08 122 | 3/1999 |
| EP | 0 749 790 | 12/1996 |
| EP | 0 894 558 | 2/1999 |

* cited by examiner

*Primary Examiner*—Kuang Y. Lin
*Assistant Examiner*—I.-H. Lin
(74) *Attorney, Agent, or Firm*—Burns, Doane, Swecker & Mathis, L.L.P.

(57) ABSTRACT

The invention relates to a method for producing a cooled cast part for a thermal turbo machine by using a known casting process. Between a wax model of the cast part and a ceramic core, a wax seal is applied by hand above a step, only on an additional shoulder. The material that is created during the casting process at this point by the shoulder and the wax seal can be ground off without causing rough areas on the step to form. This simplifies the welding or soldering of a cooling plate to the step.

7 Claims, 2 Drawing Sheets

METHOD FOR PRODUCING A COOLED, LOST-WAX CAST PART

FIELD OF THE INVENTION

1. The invention relates to a method for producing a cooled cast part produced by a lost-wax process for a thermal turbo machine.

BACKGROUND OF THE INVENTION

1. Cast parts for thermal turbo machines are produced using known casting processes. Casting furnaces for such casting processes are known, for example, from publications EP-A1-749 790, U.S. Pat. Nos. 3,763,926, or 3,690,367. The casting molds usually are provided in the form of a wax model. A process for producing a complex part of a gas turbine using a casting mold is known, for example, from publication U.S. Pat. No. 5,296,308.

2. Depending on the specific embodiment, a core is placed into the wax model. This core contains the structure of the cavity that forms a specific cooling structure inside the casting part. In these casting parts, a wax seat must be applied between the wax model and the core in order to prevent the slip, that in its dry form forms the casting mold, from penetrating into the intermediate space. The wax seal is applied by hand onto a step adjoining the core. This step has the ultimate purpose of holding a cooling plate. The cooling plate is soldered or welded onto the step and is used, by means of cooling holes, for impact-cooling the platform located below it. In order to prevent leakages of cooling air, the surface of this step should be smooth. But this is in contradiction with the applied wax seal that, after casting, results in an accumulation of material above the step. In order to get closer to the goal of a smooth surface of the step, an additional process step, for example grinding or eroding, is necessary.

SUMMARY OF THE INVENTION

1. The invention is based on the objective of creating a method for producing a thermally loaded and cooled cast part for a thermal turbo machine by using a known casting process, whereby the casting mold of the cast part is produced with a wax model and a ceramic core, and the subsequent production steps are simplified and optimized.

2. According to the invention, this objective is realized with a method for producing a cooled cast part for a thermal turbo machine by using a known casting process and a casting mold. The casting mold is produced by using a wax model and a core located inside the wax model. A step is located immediately next the core for the attachment of a cooling plate to the finished cast part. Prior to the production of the casting mold of the cast-part between the wax model and the core, the wax seal is applied to only one shoulder that is located above the step in the direction towards the side of the core.

3. This provides the advantage that even during the casting process it can already be prevented that rough areas are created on the step that would result in a leakage of the cooling air at the cooling plate. The material that is created during the casting process as a result of the wax seal and the shoulder can be ground off or removed using another appropriate manner with a uniform process step without forming rough areas on the step. A cooling plate can be soldered to this step without any additional process steps.

BRIEF DESCRIPTION OF THE DRAWINGS

1. The invention is described in reference to the enclosed drawings, whereby.

2.

3.

5. Only those elements essential to the invention are shown. Identical elements are designated with the same reference characters in the different drawings.

DETAILED DESCRIPTION OF THE INVENTION

Figure 1:
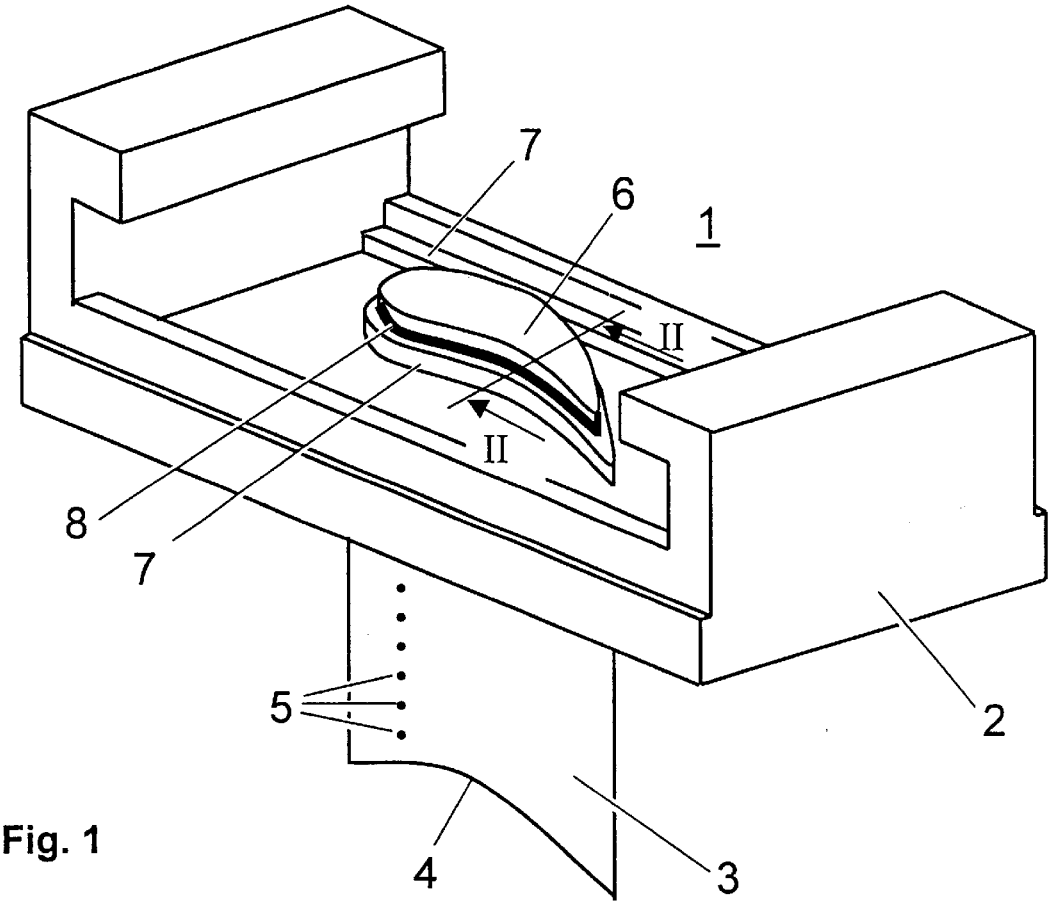
FIG. 1 shows a model of a turbine blade.

1. The invention relates to a method for producing a thermally loaded and cooled lostwax cast part for a thermal turbo machine. In particular, this may be, for example, a guide or rotating blade, or other cooled rotor or stator segments of a gas turbine or compressor. These cast parts and the method according to the invention for their production are explained in more detail below in reference to the enclosed figures.

2. The cast parts are produced using casting furnaces known generally from the state of the art. By using such casting furnaces, complex components that can be subjected to high thermal and mechanical loads can be created. Depending on the process conditions, it is hereby possible to produce the cast body in a directionally solidified manner. It can hereby be constructed as a single crystal (SX) or polycrystalline, as fringe crystals that have a preferred direction ("directionally solidified", DS). It is especially important that the directional solidification takes place under conditions at which an intensive heat-exchange takes place between a cooled part of a casting mold holding a molten starting material and the still molten starting material. This permits the formation of a zone of directionally solidified material with a solidification front that, when the heat is continuously withdrawn, migrates through the casting mold while forming the directionally solidified cast part.

3. Publication EP-A1-749 790, for example, discloses such a process and apparatus for producing a directionally solidified cast part. The apparatus comprises a vacuum chamber that contains an upper heating chamber and a lower cooling chamber. The two chambers are separated from each other by a baffle. The vacuum chamber accepts a casting mold that is filled with a molten mass. In order to produce thermally and mechanically loadable parts, such as guide or rotating blades for gas turbines, a super-alloy based on nickel can be used, for example. The baffle is provided in the center with an opening through which the casting mold is moved slowly during the process from the heating chamber to the cooling chamber, so that the cast part directionally solidifies from the top to the bottom. The downward movement is brought about with a drive rod on which the casting mold is positioned. The bottom of the casting mold is constructed with water cooling. Below the baffle, means for generating and guiding a gas stream are provided. Through the gas stream next to the lower cooling chamber, these means ensure additional cooling and therefore a greater temperature gradient at the solidification front.

4. A similar process, which in addition to the heating and cooling chamber works with an additional gas cooler, is also known, for example, from U.S. Pat. No. 3,690,367.

5. Another process for producing a directionally solidified cast part is known from publication U.S. Pat. No. 3,763,926. In this process, a casting mold filled with a molten alloy is immersed continuously into a bath heated to approximately 260° C. This achieves a particularly rapid removal of heat from the casting mold. This and other, similar processes are known under the name of LMC (liquid metal cooling).

6. For the invention, it is advantageous, that this type of casting furnaces is used for producing monocrystalline or directionally solidified, cast parts, but it is not limited to this. In principle, the solidification also can take place non-directionally.

7. FIG. 1 shows a wax model 10 of a cast part 1, for example a turbine blade to be cast. The turbine blade is provided with a platform 2, a blade vane 3, and blade tip 4. This wax model 10 then is immersed into a liquid, ceramic material, also called a slip. Hereby the later casting mold of cast part 1 is formed around the wax model 10. The ceramic model is then dried so that the casting mold with which the cast part 1 is produced is created. After the slip is dried, the wax is removed using a suitable heat treatment, i.e. is burnt away. During the process step, the casting mold is also fired, i.e. it receives its strength in this way. The cast part 1 is produced in a known manner with the casting mold created in this way by using a known casting furnace that was described in more detail above. The ceramic casting mold and the core are later removed in an appropriate manner, for, example by using a strong acid or base.

8. The turbine blade of FIG. 1 has a cavity into which cooling air is passed during the operation of the turbo machine. This cooling air is able to leave the finished turbine blade again through cooling holes 5. As seen in FIG. 1, a ceramic core 6 that reflects the internal geometry of the cavity is provided during the production process of the casting mold in the later cavity of the wax model 10. In the shown turbine blade, the platform 2 is cooled additionally by impact cooling. Hereby a cooling plate 11 provided with cooling holes 12 is soldered or welded to a step 7 next to the ceramic core 6 and on the edge of the platform 2 in this cast component. This cooling plate 11 is described in more detail in reference to FIG. 3.

9. Prior to the production of the casting mold, a wax seal 8 is manually provided between the ceramic core 6 and shoulder 9. This wax seal 8 has the objective of preventing the undesired penetration of slip into the inner chamber of the ceramic core 6.

Figure 2:
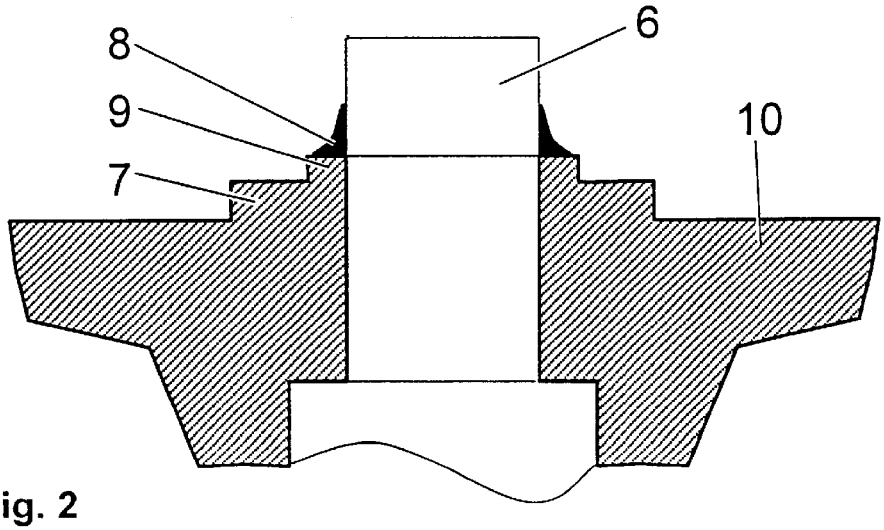
FIG. 2 shows a section through a turbine blade according to the invention along line II—II in FIG. 1, and 4.
Figure 3:
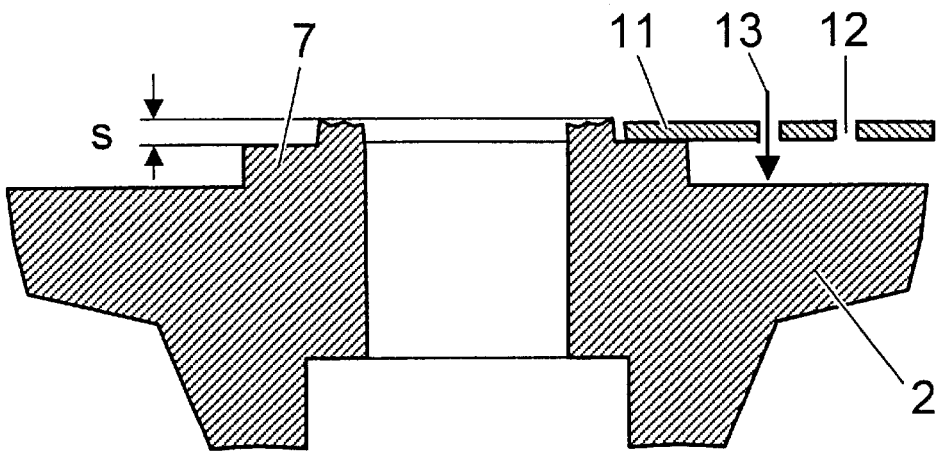
FIG. 3 shows a section through a turbine blade according to the invention along line II—II in FIG. 1 after a successful casting process.

10. FIG. 2 shows a section along line II—II of FIG. 1 that extends through the step 7, the wax seal 8, and through the ceramic core 6. According to the invention, the wax seal 8 is provided only on a shoulder 9 located above the step 7 towards the ceramic core 6. This process results in two advantages. During the casting process, the step 7 and wax seal 8 create additional, cast material on the turbine blade. As seen in FIG. 3, this material has a specific height s and can be machined, i.e. ground off, independently from step 7 or independently from the surface of step 7. This uniform process step also may be performed by erosion. In spite of this additional process step, the step 7 to which the cooling plate 11 is soldered remains unaffected, which in any case ensures a smooth surface of the step 7. The cooling air 13 penetrates through the cooling holes 12 and in this way is able to cool the platform 2 by impact cooling. The smooth surface of the step 7 is important since even small rough areas could reduce the cooling effect of this impact cooling as a result of leakage losses. Another advantage is that the existing shoulder 9 prevents the liquid solder that distributes itself over the entire step 7 from flowing into the cavity of the cast part 1. Since during the operation of the cast part an insert will be located in its cavity also, it is important that no solder adheres to this insert and thus adversely affects its proper function.

What is claimed is:

1. A method of producing a cooled cast part for a thermal turbo machine, the method comprising:

producing a wax casting model for a cooled cast part for a thermal turbo machine, the wax casting model comprising a blade tip at a first end, a blade vane, cooling holes, a platform at a second end, and a step surrounding a core;

applying a wax seal to a shoulder located above the step surrounding the core, the wax seal adjacent the core;

casting a ceramic mold, the ceramic mold having an additional ceramic material corresponding to the shoulder and the wax seal, the additional ceramic material having a specific height above the step;

removing the additional ceramic material independently from a finishing step for the step; and casting the cooled cast part.

2. The method of claim 1, further comprising attaching a cooling plate to the step of the ceramic mold prior to casting the cooled cast part, the cooling plate having cooling holes and providing impact cooling.

3. The method of claim 2, wherein attaching the cooling plate is attaching by soldering or welding.

4. The method of claim 1, wherein applying the wax seal is applying by hand.

5. The method of claim 1, wherein removing the additional ceramic material is machining or eroding.

6. The method of claim 1, wherein casting the cooled cast part results in a monocrystalline, a directionally solidified,-or a non-directionally solidified cooled cast part.

7. The method of claim 1, wherein the cooled cast part is a guide or rotating blade of a gas turbine or a compressor.

* * * * *